US005720646A

United States Patent [19]

Shannon et al.

[11] Patent Number: 5,720,646

[45] Date of Patent: Feb. 24, 1998

[54] VEHICLE FOR USE WITH GAMES OR DEMONSTRATIVE TOOLS

[76] Inventors: Suel G. Shannon, 46 South Rd. Bearskin Neck, Rockport, Mass. 01966; Douglas C. Shannon, P.O. Box 624514 1187 Prospector Trail, South Lake Tahoe, Calif. 96154

[21] Appl. No.: 759,449

[22] Filed: Dec. 5, 1996

Related U.S. Application Data

[63] Continuation-in-part of Ser. No. 508,443, Jul. 28, 1995.

[51] Int. Cl.[6] ..... A63H 17/00

[52] U.S. Cl. ..... 446/465; 446/431; 446/901; 24/33 V; 24/452

[58] Field of Search ..... 446/431, 445, 446/465, 441, 901; 434/305; 24/33 V, 33 L, 306, 442, 452; D12/136; 152/167, 209 A, 209 B, 209 D

[56] References Cited

U.S. PATENT DOCUMENTS

| | | | |
|---|---|---|---|
| D. 57,856 | 5/1921 | Olson | D12/136 |
| D. 323,135 | 1/1992 | Thomas | D12/136 |
| 385,452 | 7/1888 | Frank . | |
| 2,165,833 | 7/1939 | Bischof . | |
| 2,968,876 | 1/1961 | McIntosh . | |
| 3,031,730 | 5/1962 | Morin . | |
| 3,130,111 | 4/1964 | Izumi . | |
| 3,138,841 | 6/1964 | Naimer . | |
| 3,260,294 | 7/1966 | Campion | 24/442 |
| 3,387,345 | 6/1968 | Savoir . | |
| 3,494,070 | 2/1970 | Lemelson . | |
| 3,559,334 | 2/1971 | Beny et al. . | |
| 3,600,850 | 8/1971 | Summerfield et al. . | |
| 3,927,881 | 12/1975 | Lemelson et al. . | |
| 3,941,383 | 3/1976 | Clarke . | |
| 3,999,748 | 12/1976 | Clarke . | |
| 4,029,316 | 6/1977 | Clarke . | |
| 4,113,251 | 9/1978 | Imes, Jr. . | |
| 4,142,725 | 3/1979 | Gilbert et al. . | |
| 4,216,257 | 8/1980 | Schams et al. . | |
| 4,540,377 | 9/1985 | Rehkemper et al. . | |
| 4,547,173 | 10/1985 | Jaworski et al. . | |
| 4,601,519 | 7/1986 | D'Andrade . | |
| 4,643,696 | 2/1987 | Law | 446/465 |
| 4,715,839 | 12/1987 | Ford et al. . | |
| 4,764,148 | 8/1988 | Wong . | |
| 4,773,889 | 9/1988 | Rosenwinkel et al. . | |
| 4,984,339 | 1/1991 | Provost et al. . | |
| 5,005,844 | 4/1991 | Douglas et al. . | |
| 5,067,210 | 11/1991 | Kayaki | 24/445.2 |
| 5,102,367 | 4/1992 | Mullaney et al. | 446/465 |
| 5,131,119 | 7/1992 | Murasaki et al. | 24/452 |
| 5,476,010 | 12/1995 | Fleming et al. | 73/620 |

FOREIGN PATENT DOCUMENTS

| | | | |
|---|---|---|---|
| 1169747 | 1/1959 | France . | |
| 1010428 | 6/1957 | Germany . | |
| 1213160 | 11/1970 | United Kingdom | 446/445 |
| 2082925 | 3/1982 | United Kingdom . | |
| 2123704 | 2/1984 | United Kingdom . | |

*Primary Examiner*—Robert A. Hafer
*Assistant Examiner*—Jeffrey D. Carlson
*Attorney, Agent, or Firm*—Steven N. Fox, Esq.

[57] ABSTRACT

Disclosed is a vehicle having a body portion which may be rolled upon and secured to a mating surface. In one embodiment, the vehicle comprises a first axle having a wheel member mounted thereon and a second axle having another wheel member mounted thereon. Each of the wheel members comprise an integral fastening portion of the same material as the wheel that is engagable with the mating surface so that the vehicle may be secured to the mating surface regardless of the orientation of the mating surface.

21 Claims, 10 Drawing Sheets

VEHICLE FOR USE WITH GAMES OR DEMONSTRATIVE TOOLS

This is a continuation-in-part of copending application Ser. No. 08/508,443 filed on Jul. 28, 1995.

FIELD OF THE INVENTION

The present invention relates generally to vehicles used in connection with games or demonstrative tools. More specifically, the present invention relates to vehicles having one or more rotatable wheels.

BACKGROUND OF THE INVENTION

Since the invention of the wheel, vehicles of various constructions have been used by children and adults to roll over both real and imaginary surfaces. Such vehicles are commonly used in connection with games or demonstrative tools. Many attempts have been made in the past to improve the outer surface of the wheel to create facial interactions between the wheel and the mating surface. For example, U.S. Pat. No. 4,773,889 discloses a toy vehicle having wheels designed with a slotted outer surface which provides an added gripping means for the vehicle when traveling over rough terrain. U.S. Pat. No. 4,643,696 discloses a wheel design with retractable claws which extend outwardly beyond the normal wheel surface to deliver added traction when required. U.S. Pat. No. 4,601,519 discloses a design which automatically extends a spike out beyond the wheel surface when required by the traction needs.

Vehicles of the type identified above have several disadvantages when used in connection with games or demonstrative tools. None of the above patents provide an interface between the wheel and the mating surface such that the weight of the vehicle can be supported by the interfacial forces when the mating surface is moved to a non-horizontal position. As such, vehicles of the type identified above would fall off the mating surface if the mating surface were positioned in a non-horizontal position thereby causing inconvenience and/or annoyance to the player of the game or the user of the demonstrative tool.

SUMMARY OF THE PRESENT INVENTION

A first object of the present invention is to provide a vehicle having an interfacial wheel-to-mating surface which allows the vehicle to remain secured to a mating surface regardless of the orientation of the mating surface (i.e, horizontal, vertical or inverted).

A second object of the present invention is to provide a vehicle which allows a person to roll the vehicle upon a mating surface with ease in all directions while continuously having an interfacial wheel-to-mating surface which allows the vehicle to remain secured to the mating surface regardless of the orientation of the mating surface.

The above objects are realized by the present invention which in a first embodiment comprises a vehicle having at least one wheel member rotatably connected about an axle. The outer portion of the wheel member comprises a fastening portion. The vehicle of the present invention may be used in connection with a game board or a demonstrative tool having a mating surface. In operation, the fastening portion of the wheel member may be engaged with the mating surface while a person is rolling the vehicle upon the mating surface. As a result of the engagement of the fastening portion of the wheel member with the mating surface, the vehicle will remain secured to the mating surface regardless of the orientation of the mating surface.

The fastening portion of the wheel member and the mating surface may be made from a variety of materials and designs such as hermaphroditic designs wherein the fastening portion of the wheel member is of the same sex type as the mating surface or non-hermaphroditic designs wherein the fastening portion of the wheel member is of a different sex type as the mating surface. In one embodiment, the fastening portion of the wheel member comprises a series of spaced hooks which are integrally molded as part of the wheel member and the mating surface is made from a conventional loop material of the type marketed under the tradename Velcro.

BRIEF DESCRIPTION OF THE DRAWINGS

The following detailed description of the present invention will be more fully understood with reference to the accompanying drawings in which.

DETAILED DESCRIPTION OF THE PREFERRED EMBODIMENTS

Figure 1:
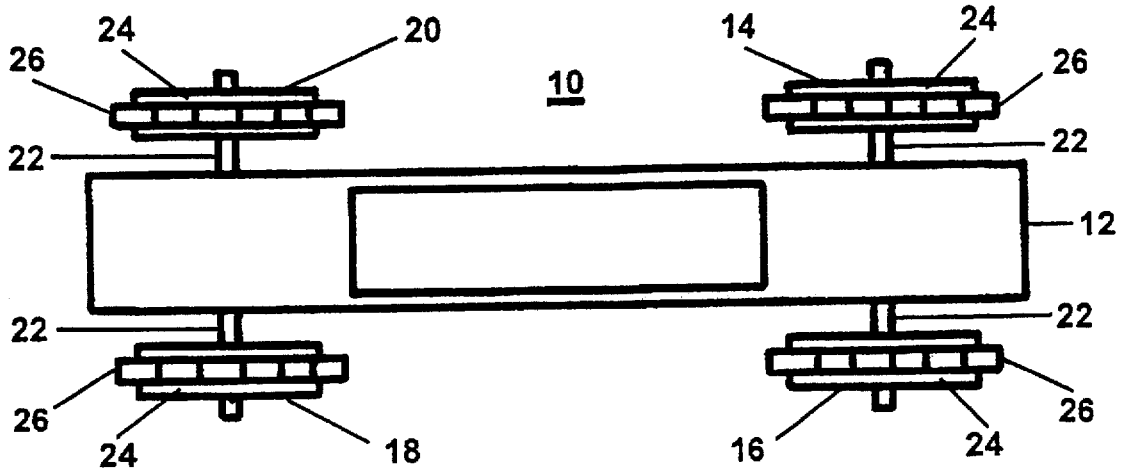
FIG. 1 is a top view of one embodiment of the present invention showing a vehicle having a single wheel member rotatably mounted on each of four axles.

Referring to FIG. 1, where one embodiment of the vehicle 10 of the present invention is shown generally comprising a vehicle body 12 having single wheel members 14, 16, 18 and 20 rotatably mounted about axles 22. Each of the wheel members 14, 16, 18 and 20 comprises an outer portion 24 and a fastening portion 26.

Figure 2:
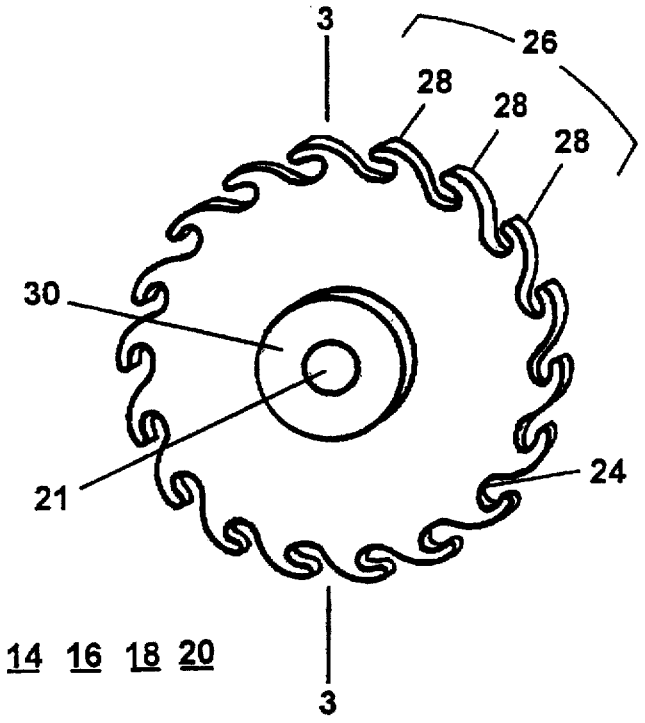
FIG. 2 is a perspective view of a single wheel member having a fastening portion which in one embodiment comprises a series of spaced of hooks in a single row facing in the same direction and integrally formed as part of the single wheel member.
Figure 3:
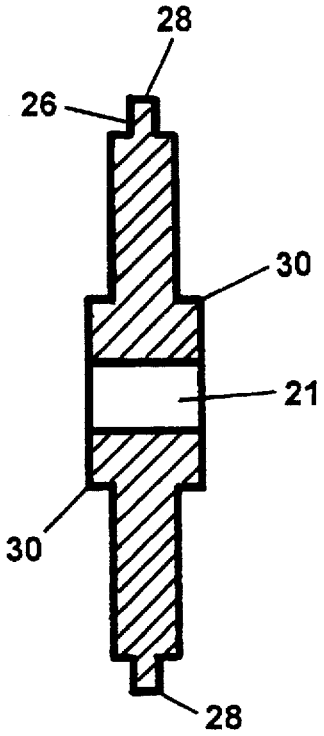
FIG. 3 is a cross section view taken along line 3—3 of FIG. 2.

As shown by FIGS. 2–3, in one embodiment of the wheel member 14, the fastening portion 26 may comprise a series of hooks 28 equidistantly spaced along the outer portion 24. Each of the hooks 28 are aligned in a single row and face in the same direction. The wheel member 14 may further comprise an opening 21 adapted so that the wheel member may freely rotate about the axle 22. The wheel member 14 may further comprise a flanged or hub portion 30. As will be hereinafter described, the hub portion 30 is advantageous when a plurality of wheel members are used on a single axle to allow the wheel members to roll independently of each other and to prevent the mating surface (to be described) from becoming caught between the wheel members.

Figure 4:
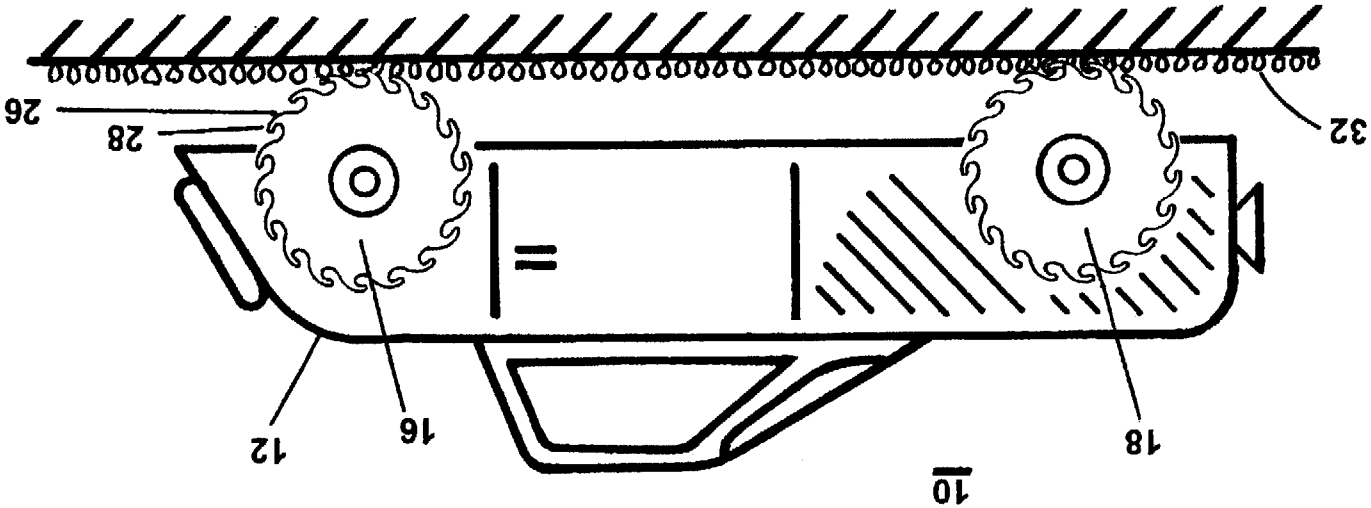
FIG. 4 is a plan view showing a vehicle secured to one embodiment of the mating surface when the mating surface is orientated in the vertical position.
Figure 5:
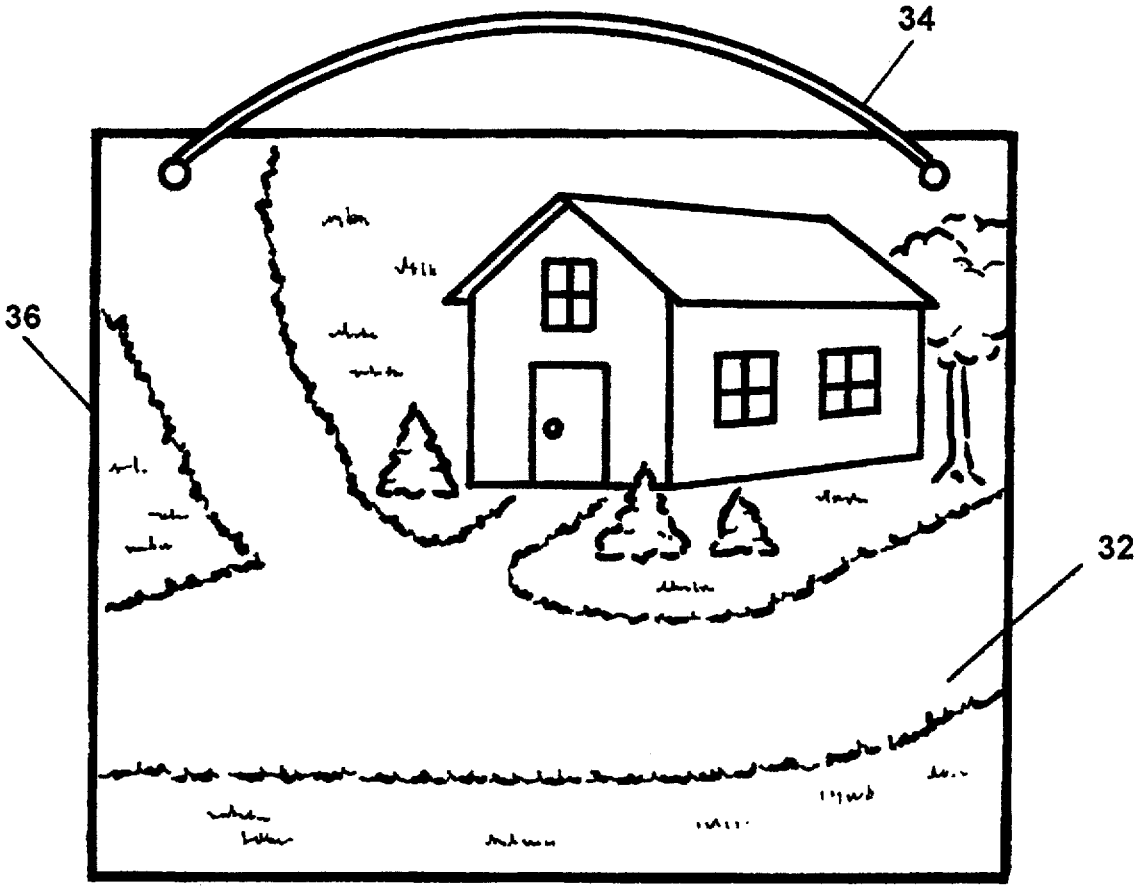
FIG. 5 is a top view showing one embodiment of the mating surface of the present invention.

As shown by FIGS. 4–5, the vehicle 10 may be rolled upon a mating surface 32 which in one embodiment is made from a conventional loop material of the type marketed under the tradename Velcro. The fastening portion 26 of the wheel members 16 and 18 (which in the embodiment shown comprises a series of hooks 28) may be engaged with the mating surface 32 while a person is rolling the vehicle upon the mating surface 32. As a result of the engagement of the fastening portions 26 with the mating surface 32, the vehicle 10 will remain secured to the mating surface 32 regardless of the orientation of the mating surface 32. By way of example only, the mating surface 32 may be formed as part of a game board or a demonstrative device 36 such as those used in classes and court rooms. In practice the mating surface 32 may be orientated in the horizontal position or may for example comprise a strap 34 which allows the mating surface 32 to be placed in a non-horizontal position such as the vertical or inverted position. The mating surface 32 is preferably made from a material which will securely engage or interlock with the chosen fastening portion 26 of each wheel members.

Figure 6:
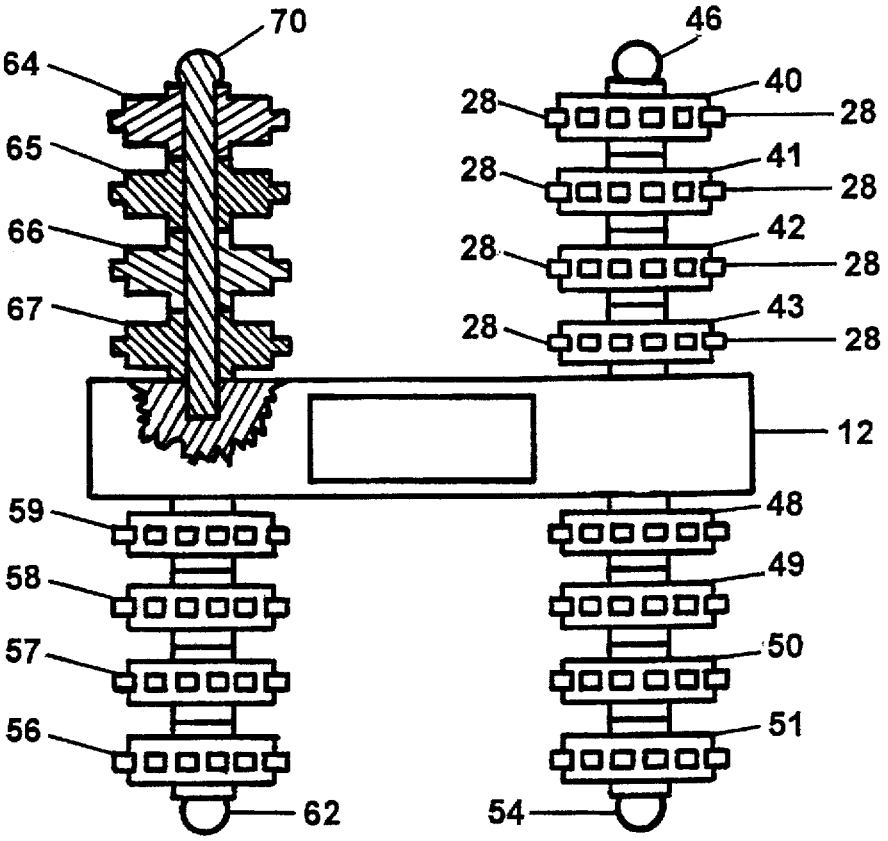
FIG. 6 is a top view of another embodiment of the present invention with a selected sectional view showing a vehicle having four single wheel members on each of four axles.

FIG. 6 shows another embodiment of the present invention wherein the vehicle 10 is provided with a first set of wheel members 40–43 mounted about an axle 46, a second set of wheel members 48–51 mounted about an axle 54, a third set of wheel members 56–59 mounted about an axle 62, and a fourth set of wheel members 64–67 mounted about an axle 70. The wheel members 40–43 can freely rotate about the axle 46 and independent of each other. Each of the wheel members 40–43 are similar to the wheel member 14 described heretofore which comprises a fastening portion 26 which in one embodiment may comprise a series of spaced hooks 28 aligned in a single row and facing in the same direction. Each of the wheel members 40–43 comprise the hub or flanged portion 30 which allow the wheel members 40–43 to roll easily and independently of each other and to prevent the mating surface 32 from becoming caught between the wheel members 40–43.

The wheel members 40–43 are preferably mounted upon the axle 46 so that upon assembly adjacent wheel members have hooks 28 which face in directions opposite to each other. In other words, hooks 28 of wheel member 40 face in the opposite direction with respect to the hooks 28 of wheel member 41. Similarly, hooks 28 of wheel member 41 face in the opposite direction with respect to the hooks 28 of wheel member 42 and hooks 28 of wheel member 42 face in the opposite direction with respect to the hooks 28 of wheel member 43.

Similarly, the wheel members 48–51 are mounted upon the axle 54 such that adjacent wheel members having hooks 28 which face in the opposite direction. Similarly, the wheel members 56–59 are mounted upon the axle 62 such that adjacent wheel members have hooks 28 which face in the opposite direction. Similarly, the wheel members 64–67 are mounted upon the axle 70 such that adjacent wheel members have hooks 28 which face in the opposite direction.

In the embodiment, the vehicle 10 has four single wheel members on each axle. It should be readily apparent that the vehicle 10 could be configured to have more or less than four wheel members on each axle. However, it is preferably to have a configuration wherein even multiple pairs of wheel members are present on each axle (i.e, two, four, six, eight, etc.)

The use of a plurality of wheel members having hooks facing in a direction opposite the adjacent wheel member tends to provide a vehicle which has equal gripping or interfacial forces in either the rolling forward or backward direction. However, the use of a plurality of independent wheel members (regardless of direction of hooks) tends to provide a vehicle which easily turns corners when rolling on the mating surface 32.

Heretofore, one embodiment of the fastening portion 26 of the wheel members has comprised a series of spaced of hooks 28 in a single row facing in the same direction and integrally formed as part of the single wheel member. In this embodiment, the fastening portion 26 may be used in connection with a mating surface which is made from a loop type material. However, it should be readily apparent that the fastening portion 26 of the wheel members and/or the mating surface 32 may be made from numerous types of materials and design configurations so long as the gripping or interfacial forces created between the fastening portion and the mating surface are large enough to keep the vehicle secured to the mating surface regardless of the orientation of the mating surface.

Figure 7:
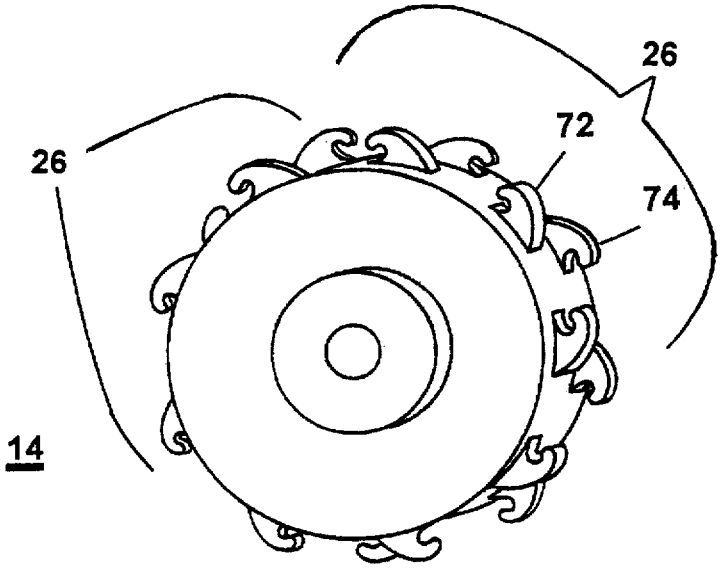
FIG. 7 is a perspective view of a single wheel member having a fastening portion which in one embodiment comprises a series of spaced hooks in two different rows and which face in the opposite direction.

By way of example and as shown in FIG. 7, the fastening portion 26 of the single wheel member 14 may comprise a first row of spaced hooks 72 and a second row of spaced hooks 74. The first row of hooks 72 face in a direction opposite the second row of hooks 74. This embodiment is essentially a combination of two wheel members each having a single row of hooks which face in the opposite direction. Alternatively, hooks 72 and 74 could be aligned in a single row and on a single wheel member.

Figure 8:
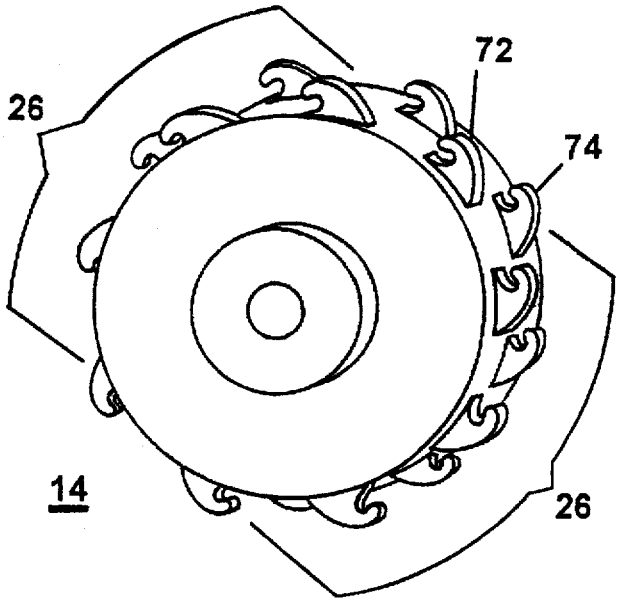
FIG. 8 is a perspective view of a single wheel member having a fastening portion which in one embodiment comprises a series of spaced hooks in two different rows and which face in the same direction.

As shown in FIG. 8, the fastening portion 26 of the single wheel member 14 may in another embodiment comprise a first row of spaced hooks 72 and a second row of spaced hooks 74. The first row of hooks 72 face in the same direction as the second row of hooks 74.

Figure 9:
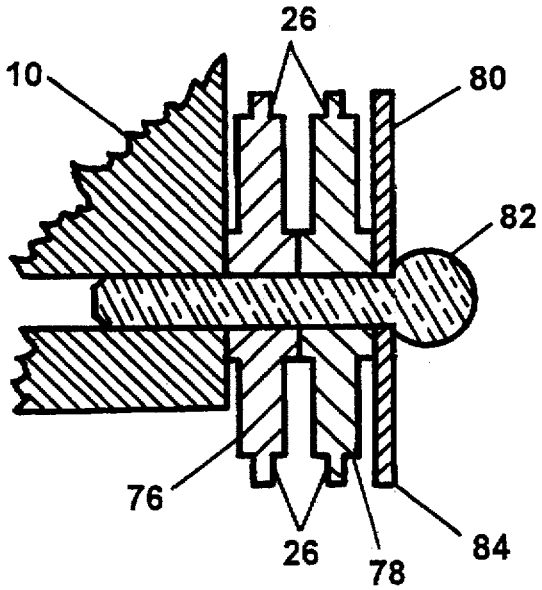
FIG. 9 is a sectional view of a pair of single wheel members having a fastener portion and a single protective disk rotatably mounted on a single axle.

FIG. 9 shows another embodiment of the present invention wherein a pair of single wheel members 76 and 78 and a single protective disk 80 are rotatably mounted on an axle 82. The protective disk 80 is constructed as a solid circular wheel member without any fastening portion 26. The protective disk 80 is provided so that if the vehicle 10 is rolled on a hard surface, the fastening portions 26 are not deformed or otherwise damaged. In the preferred embodiment, a protective disk 80 may be provided on each axle of the vehicle 10. Although not shown, additional protective disks 80 could be added on each axle. The protective disk 80 may be designed in a number of ways or constructed from a variety of materials. For example, the periphery or outer edge 84 of the protective disk 80 may be chamfered or rounded. Preferably the protective disk 80 is made to be stronger and more durable than the wheel members 76 and 78.

Figure 10:
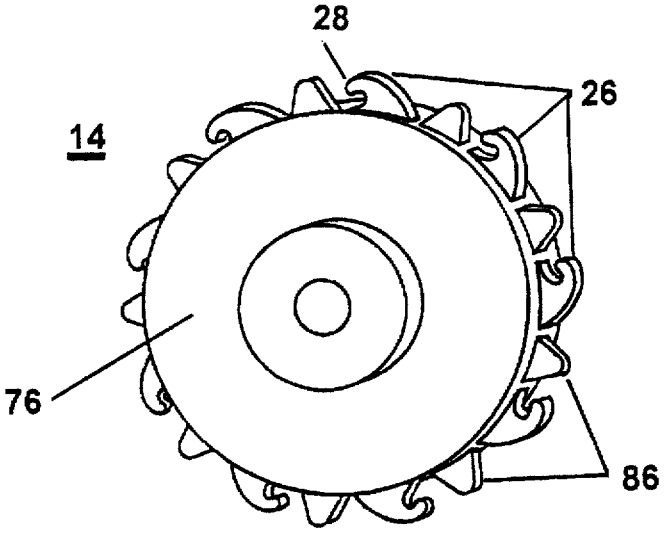
FIG. 10 is a perspective view of a single wheel member having a fastening portion which in one embodiment comprises a series of spaced hooks in a single row with a single solid boss spaced between each hook.

As shown by FIG. 10, the protective disk 80 of FIG. 9 may be integrally formed or designed as part of the wheel member 76. In this embodiment, the fastening portion 26 comprises a plurality of hooks 28 which are alternately spaced about bosses or protrusions 86. The bosses 86 are preferably solid so as to prevent the compression or otherwise deformation of the fastening portion 26 when the vehicle 10 is pressed firmly against a hard surface in either the stationary or rolling position.

Figure 11:
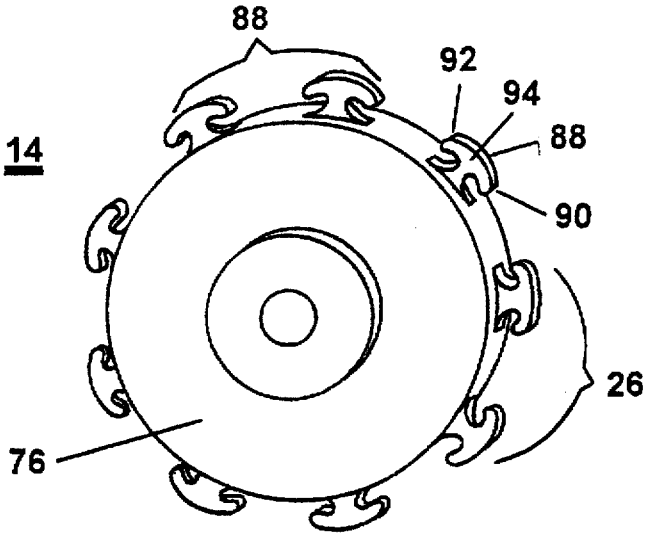
FIG. 11 is a perspective view of a single wheel member having a fastening portion which in one embodiment comprises a series of dual facing hooks formed with an integral boss in a single row.
Figure 12:
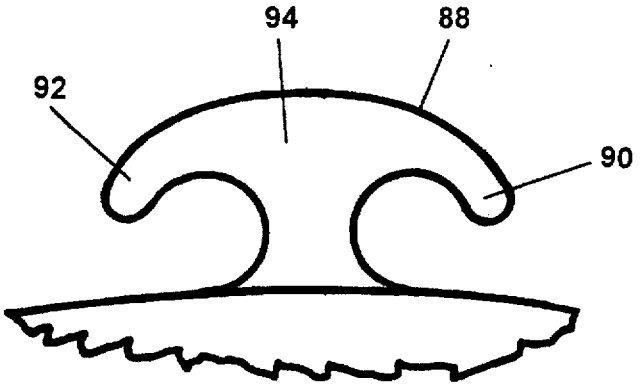
FIG. 12 is a front view of the dual facing hook of FIG. 11.

As shown by FIGS. 11–12, the wheel member 76 may comprise a fastening portion 26 which comprises a series of dual facing hooks 88 which are shown aligned in a single row. Each of the dual facing hooks 88 integrally comprises a first hook portion 90, a second hook portion 92 and a boss portion 94. In this embodiment, the dual facing hook 88 has the features of both opposite facing hooks and a protective boss.

As stated heretofore, it should be readily apparent that the fastening portion 26 of the wheel members and/or the mating surface 32 may be made from numerous type of materials and design configurations so long as the gripping or interfacial forces created between the fastening portion and the mating surface are large enough to keep the vehicle secured to the mating surface regardless of the orientation of the mating surface. For example, the fastening designs may be hermaphroditic designs wherein the fastening portion 26 of the wheel members are of the same sex type as the mating surface 32 or non-hermaphroditic designs wherein the fastening portions 26 of wheel members are of a different sex type as the fastening portion of the mating surface 32. For example, the fastening portion of the wheel members may comprise a loop type material and the mating surface 32 may comprise a series of hooks. By way of further example, the fastening portion 26 of the wheel members and the mating surface might easily be made from the materials disclosed in the following U.S. patents:

U.S. Pat. No. 4,216,257 discloses a hermaphroditic design having flexible headed projections. U.S. Pat. No. 4,216,257 in its entirety is hereby incorporated by reference into this specification;

U.S. Pat. No. 3,130,111 discloses a hermaphroditic design having hook and loop fasteners. U.S. Pat. No. 3,130,111 in its entirety is hereby incorporated by reference into this specification;

U.S. Pat. Nos. 4,875,259 and 5,201,101 each discloses a hermaphroditic design having tapered elements. U.S. Pat. Nos. 4,875,259 and 5,201,101 in their entirety are hereby incorporated by reference into this specification;

U.S. Pat. No. 3,387,345 discloses a hermaphroditic design having hook and loop fasteners. U.S. Pat. No. 3,387,345 in its entirety is hereby incorporated by reference into this specification; and U.S. Pat. No. 3,138,841 discloses a non-hermaphroditic design. U.S. Pat. No. 3,138,841 in its entirety is hereby incorporated by reference into this specification.

Figure 13:
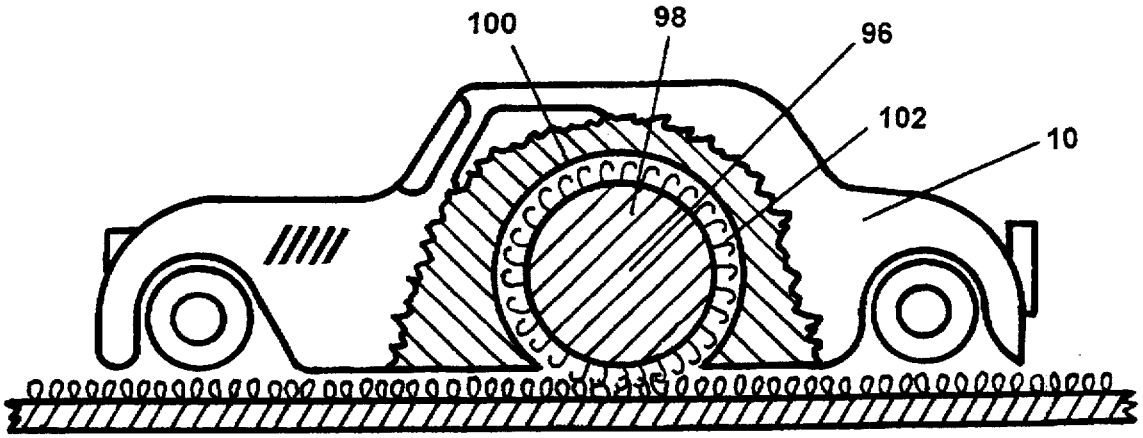
FIG. 13 is a plan view showing another embodiment of the present invention with a selected sectional view wherein the vehicle comprises a wheel member in the form of ball which can freely rotate within its own socket or cavity.

As heretofore described, the wheel members have been primarily formed of a disk shape. However, the wheel members may take a variety of forms and shapes. By way of example only and as shown in FIG. 13, the vehicle 10 may comprise a wheel member 96 in the form of ball 98 which can freely rotate without an axle and within its own socket or cavity 100. The fastening portion 102 may be disposed over the entire surface area of the ball 98 and may comprise a plurality of hooks or may be made from a variety of designs and materials as heretofore described.

As heretofore described, the vehicle 10 has taken the form of a car for use with games or demonstrative devices. However, the vehicle 10 may take the form of any object which is rolled upon a surface. By way of example, the vehicle 10 may take the form of a computer mouse having a single wheel member in the form of a ball. In this application, the computer mouse could for example be rolled about a mating surface in any orientation to a desired position and the fastening material of the wheel members (disposed about the ball) may be engaged with the mating surface as herein described.

Figure 14:
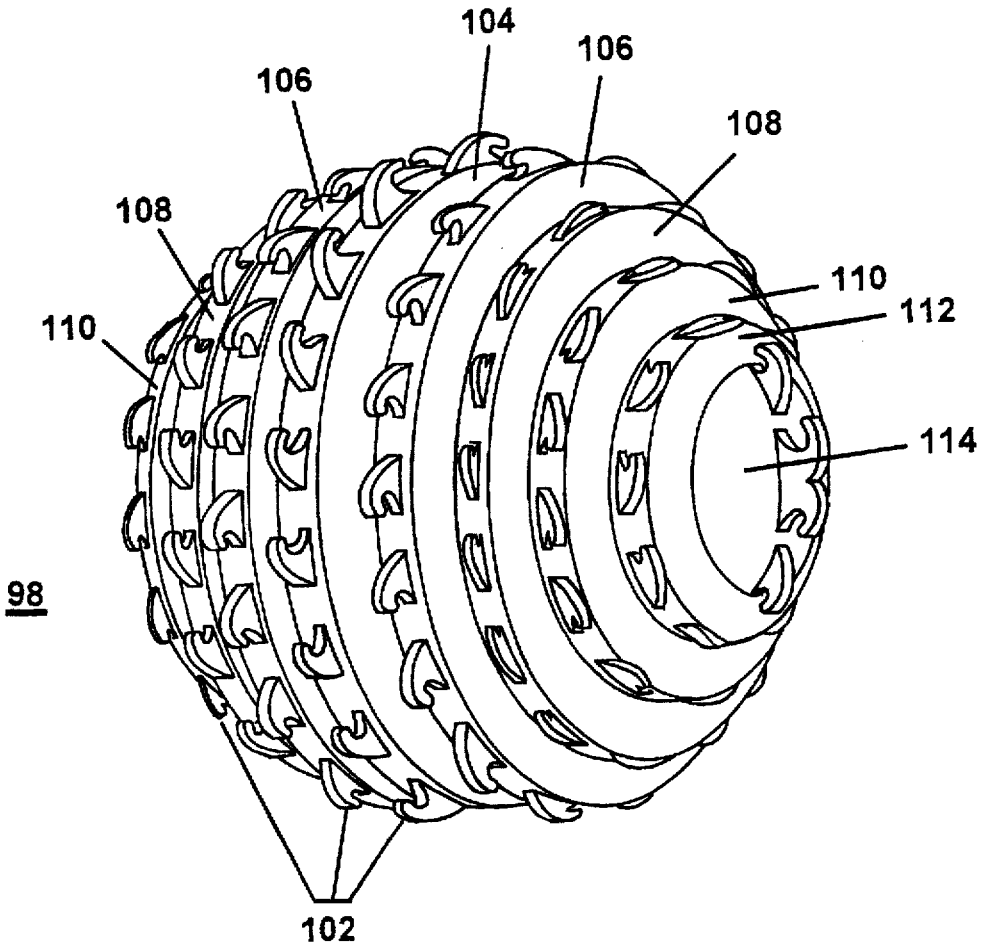
FIG. 14 is a perspective view of one embodiment of the ball wheel assembly of FIG. 13.
Figure 15:
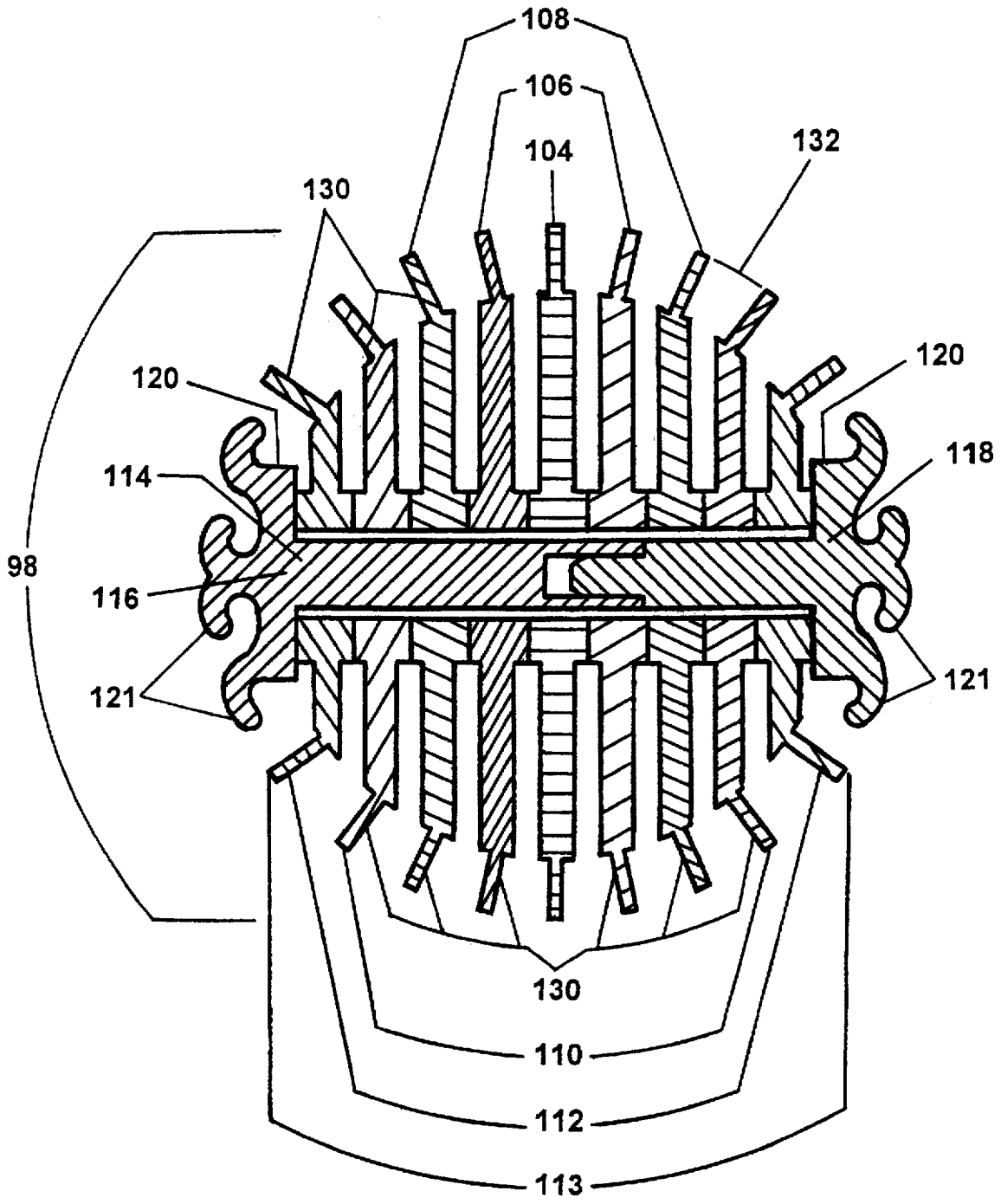
FIG. 15 is a section view of the ball wheel of FIG. 14.
Figure 16:
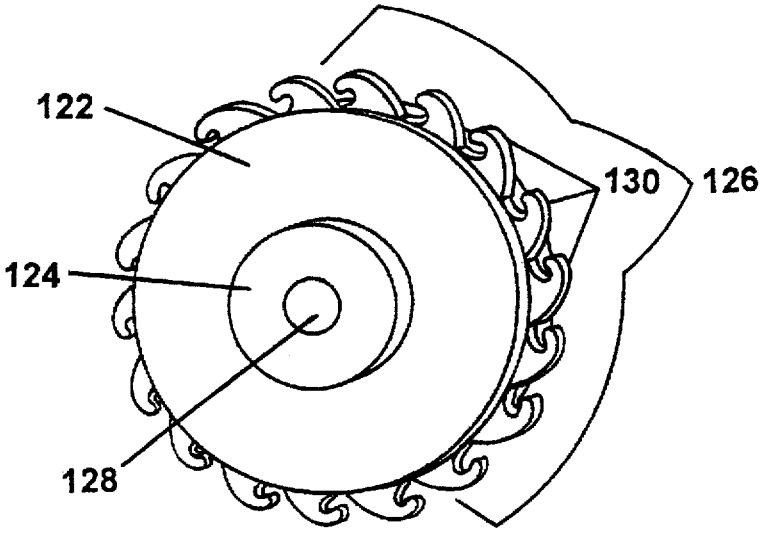
FIG. 16 is a perspective view of the disk members of FIGS. 14 and 15.

Referring to FIGS. 14–16 wherein one embodiment of the ball wheel assembly 98 is shown comprising a series of molded disk members 104, 106, 108, 110 and 112 arranged in parallel planes to form a disk assembly 113. In the disk assembly 113, each disk member has a unitary one piece construction having a main body portion 122, a central hub 124 and a fastening portion 126. The fastening portion 126 is located about the periphery of the main body portion 122 and consists of a series of fastening hooks 130 for engagement with the mating surface 32. The hooks 130 are designed in configurations similar to those shown in FIGS. 2, 7, 8, and 10–12. Each of the central hubs 124 has a center hole 128 for engagement with the axle assembly 114. Fastening hooks 130 are positioned on the disk members 104, 106, 108, 100 and 112 at various angles with relationship to the plane of the disk members such as to allow the most efficient engagement with the mating surface 32. In the disk assembly 113, disk member 104 is the central disk and has the largest outside diameter. Disk members 106 are located on both sides of disk member 104 and each has an outside diameter slightly less than disk member 104. Disk members 108 are located on both sides of disk member 106 and each has an outside diameter slightly less than disk member 106. Disk members 110 are located on both sides of disk member 108 and each has an outside diameter slightly less than disk member 108. Disk members 112 are located on both sides of disk member 110 and each has an outside diameter slightly less than disk member 110. Additional disk members can be added as required or a lesser number of disk members can be used as design requirements change. The disk assembly 113 is mounted on an axle assembly 114. The axle assembly 114 is constructed from a first axle member 116 and a second axle member 118. Both first axle member 116 and second axle member 118 have axle end plates 120 which confine the disk assembly 113 within a defined length. Both first axle member 116 and second axle member 118 have fastening means 121 extending outwardly from the axle end plates 120 which is similar to hooks 130. The axle assembly 114 can be secured by a variety of means such as ultrasonic bonding, adhesive bonding, threaded joint or other methods typically available in engineering design standards. The axle assembly 114 is completely contained within the outer surface of ball 98. With the disk assembly 113 mounted on the axle assembly 114, the ball 98 has a unified, spherical external surface 132 consisting of the fastening portions 126 of the disk assembly 113 and the fastening portions 121 of the axle assembly 114. With the disk assembly 113 mounted on the axle member 114, the disk members 104, 106, 108, 100 and 112 are free to rotate about the axle assembly 114 and to rotate independently of each other. Disk members 112 are further free to rotate freely in relationship with the adjacent axle end plates 120. First and second axle members 116 and 118 are not free to rotate with respect to each other.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A toy vehicle system comprising:

(a) a toy body member;

(b) an axle member engaged with said body member;

(c) a wheel assembly comprising first and second one piece unitary disk shaped members rotatable about said axle member, said first and second disk shaped members being free to rotate independently of each other, each of said first and second disk shaped members comprising a first portion having an opening adapted to receive said axle member and a second portion being located about the periphery of said disk shaped member, said second portions comprising a plurality of hook shaped members aligned in a substantially single row and said plurality of hook shaped members facing in the same direction, each of said first and second disk shaped members and said plurality of hook shaped members being made of the same material; and (d) a mating surface having a plurality of looped shaped members adapted to engage with said hook shaped members.

2. The device of claim 1, wherein said first and second disk members comprise a hub portion adapted to prevent said upper portion of said first and second disk shaped member from coming in contact with each other.

3. The device of claim 1 wherein said vehicle further comprises a protective disk mounted on said axle member to prevent deformation of said first and second disk shaped members.

4. The device of claim 1, wherein said hook shaped members of said first disk shaped member face in a direction opposite to the direction of said hooked shaped members of said second disk shaped member.

5. The device of claim 1, wherein said second portion of said first and second disk shaped members further comprise a plurality of bosses to protect deformation of said hook shaped members.

6. The device of claim 5, wherein said bosses and said hook shaped members are aligned in a substantially single row.

7. The device of claim 1, wherein said hooked shaped members are dual facing hooks, each of said dual facing hooks comprise a first hook portion, a second hook portion, and a boss portion, said first hook portion faces in a direction opposite said second hook portion.

8. The device of claim 1, wherein the vehicle further comprises a second axle member engaged with said body member and a second wheel assembly comprising first and second one piece unitary disk shaped members rotatable about said second axle member, said first and second disk shaped members being free to rotate independently of each other, each of said first and second disk shaped members comprising a first portion having an opening adapted to receive said second axle member and a second portion being located about the periphery of said disk member, said second portion comprising a plurality of hook shaped members aligned in a substantially single row and said plurality of hook shaped members facing in the same direction, each of said first and second disk shaped members and said plurality of hook shaped members being made of the same material.

9. A toy vehicle adapted to engage with a mating surface having a plurality of looped shaped members, the toy vehicle comprising:

(a) a toy body member;

(b) a first axle member;

(c) a first wheel assembly comprising a first one piece unitary disk member rotatable about said first axle member, said first disk member comprising a first portion having an opening adapted to receive said first axle member and a second portion being located about the periphery of said first disk member, said second portion comprising a first set of hook members, said first portion and said first set of hook members being made of the same material; and (d) a mating surface having a plurality of looped shaped members adapted to engage with said hook shaped members.

10. The toy vehicle of claim 9, wherein said first wheel assembly further comprises a second unitary disk member rotatable about said first axle member, said second disk member comprising a first portion having an opening adapted to receive said first axle member and a second portion being located about the periphery of said second disk member, said second portion comprising a first set of hook members, said first portion and said first set of hook members being made of the same material.

11. The toy vehicle of claim 10 further comprising a second axle member and a second wheel assembly comprising a first one piece unitary disk member rotatable about said second axle member, said first disk member comprising a first portion having an opening adapted to receive said second axle member and a second portion being located about the periphery of said first disk member, said second portion comprising a first set of hook members, said first portion and said first set of hook members being made of the same material.

12. The toy vehicle of claim 11, wherein said second wheel assembly further comprises a second unitary disk member rotatable about said second axle member, said second disk member comprising a first portion having an opening adapted to receive said second axle member and a second portion being located about the periphery of said second disk member, said second portion comprising a first set of hook members, said first portion and said first set of hook members being made of the same material.

13. The toy vehicle of claim 12, wherein said first set of hook members of said first and second disk members of said first and second wheel assembly are each aligned in a substantially single row.

14. The toy vehicle of claim 13, wherein said first set of hook shaped members of said first and second disk members of said first and second wheel assembly each face in the same direction.

15. The toy vehicle of claim 12, wherein said first set of hook members of said first disk member of said first wheel assembly face in a direction opposite to the direction of said first set of hook members of said second disk member of said first wheel assembly and wherein said first set of hook members of said second wheel assembly each face in a direction opposite to the direction of said first set of hook members of said second disk member of said second wheel assembly.

16. The toy vehicle of claim 12, wherein said second portion of said first and second disk shaped members of said first and second wheel assembly each comprise a second set of hook members, said first set of hook members being aligned in a first row and said second set of hook members being aligned in a second row.

17. The toy vehicle of claim 16, wherein said hook members of said first row face in a direction opposite to said hook members of said second row.

18. The toy vehicle of claim 12, wherein said first and second disk members of said first and second wheel assembly each comprise a hub portion adapted to prevent said upper portions of said first and second disk members from coming in contact with each other.

19. The toy vehicle of claim 12, wherein said first and second wheel assembly each comprise a protective disk to prevent deformation of said first and second disk members.

20. The toy vehicle of claim 12, wherein said second portion of said first and second disk members of said first and second wheel assembly each comprise a plurality of bosses to protect deformation of said hook members.

21. The toy vehicle of claim 12, wherein said hooked members of said first and second disk members of said first and second wheel assembly are each dual facing hooks, each of said dual facing hooks comprise a first hook portion, a second hook portion, and a boss portion, said first hook portion faces in a direction opposite said second hook portion.

* * * * *